US009242710B2

(12) United States Patent
Rolla

(10) Patent No.: US 9,242,710 B2
(45) Date of Patent: Jan. 26, 2016

(54) TRIMMABLE RUDDER

(75) Inventor: Philip Rolla, Bruzella (CH)

(73) Assignee: Twin Disc, Inc., Racine, WI (US)

( * ) Notice: Subject to any disclaimer, the term of this patent is extended or adjusted under 35 U.S.C. 154(b) by 287 days.

(21) Appl. No.: 13/598,181

(22) Filed: Aug. 29, 2012

(65) Prior Publication Data

US 2014/0060412 A1 Mar. 6, 2014

(51) Int. Cl.

| | |
|---|---|
| ***B63H 25/06*** | (2006.01) |
| ***B63H 25/14*** | (2006.01) |
| ***B63H 25/38*** | (2006.01) |
| ***B63H 25/30*** | (2006.01) |
| ***B63H 25/36*** | (2006.01) |

(52) U.S. Cl.

CPC ..... *B63H 25/06* (2013.01); *B63H 25/30* (2013.01); *B63H 25/36* (2013.01); *B63H 25/38* (2013.01); *B63H 25/382* (2013.01); *B63H 2025/066* (2013.01); *B63H 2025/385* (2013.01)

(58) Field of Classification Search

CPC .. B63H 25/06; B63H 2025/066; B63H 25/30; B63H 25/38; B63H 25/381; B63H 25/382; B63H 25/384; B63H 25/385; B63H 25/36

USPC ..... 114/162–172

See application file for complete search history.

(56) References Cited

U.S. PATENT DOCUMENTS

| | | | | |
|---|---|---|---|---|
| 2,653,563 | A * | 9/1953 | Long | 114/39.21 |
| 3,381,649 | A * | 5/1968 | Ward | 114/169 |
| 4,382,796 | A | 5/1983 | Blanchard | |
| 4,506,621 | A | 3/1985 | Vanlerberghe | |
| 5,346,315 | A | 9/1994 | Strong et al. | |
| 5,358,435 | A | 10/1994 | Rodskier | |
| 5,359,956 | A | 11/1994 | Lee | |
| 5,445,100 | A | 8/1995 | Finkl | |
| 5,746,147 | A | 5/1998 | Carnevali | |
| 6,149,337 | A | 11/2000 | Newton et al. | |
| 7,104,853 | B1 | 9/2006 | Kepka | |
| 7,134,923 | B1 | 11/2006 | Leach et al. | |
| 2005/0235895 | A1 | 10/2005 | Furlong | |
| 2007/0125287 | A1 | 6/2007 | Walker | |

FOREIGN PATENT DOCUMENTS

| | | |
|---|---|---|
| JP | 57-066096 | 4/1982 |
| WO | 2009/154449 | 12/2009 |
| WO | 2011/057913 | 5/2011 |

OTHER PUBLICATIONS

English translation of JP 57-066096 A (Feb. 2015).*

* cited by examiner

*Primary Examiner* — Ajay Vasudeva

(74) *Attorney, Agent, or Firm* — Boyle Fredrickson S.C.

(57) ABSTRACT

A trimmable rudder system for a marine vessel such as a planing power boat, the system including a pair of rudder assemblies, each of which includes a rudder blade movably coupled to the hull by way of a ball-and-socket joint. Each rudder assembly includes a rudder shaft that extends from the rudder blade through the ball-and-socket joint and can be rotated for rotating the rudder blade to steer the power boat. Each rudder shaft may be operably coupled to a pair of actuators configured to control trim and camber positions of the rudder blade so that the pair of rudder blades can collectively achieve a desired hull trim change, including listing control and planing control of the power boat. Steering position, trim position, and camber position of the rudder blades may be simultaneously changed.

21 Claims, 4 Drawing Sheets

TRIMMABLE RUDDER

BACKGROUND OF THE INVENTION

1. Field of the Invention

The present invention generally relates to marine trimming systems and, more particularly, to a rudder configured for steering and trimming a marine vessel.

2. Discussion of the Related Art

Flaps and trim tabs are known for influencing primarily rod and pitch movements of marine vessels to control listing and assist planing of the vessels so that the vessels can be stabilized at a desired attitude. This is typically accomplished by one or more flaps or trim tabs coupled, attached, or otherwise carried by a larger component or structure of the vessel, such as on a lower portion of a transom wall of the vessel. As is generally understood, adjustments are typically carried out by adjusting an angle of the flaps or trim tabs relative to the larger component or structure.

Flaps and trim tabs of the kind generally known in the art have a single degree of freedom, of movement with respect to the component to which they are mounted. Each of the flaps and trim tabs pivots about a single pivot axis that is typically arranged generally horizontally so that up and down pivoting of the flap or trim tab provides a pitch-type rotation that defines the single degree of freedom of movement. Pivoting a flap or trim tab down presents a relatively large surface area to the water and increases hydrodynamic appendage drag. This provides negative lift by way of reactionary forces to the hydrodynamic appendage drag that roll and/or pitch the vessel to oppose a non-desired oppositely directed roll and/or pitch that is being corrected to reduce listing or assist planing of the vessel.

SUMMARY OF THE INVENTION

The present invention is directed to a trimmable rudder system for vessels such as power boats that include a pair of rudder blades that are independently moveable in multiple directions to allow the rudder blades to be positioned with respect to each other so as to collectively achieve a desired hull trim change, including listing control and planing control of the power boat. Each of the rudder blades may have three rotational degrees of freedom so that each of the rudder blades can rotate about X, Y, and Z axes. This may be done with a ball-and-socket joint at each of the rudder blades that allows their independent position adjustability. This allows the rudder blades to be positioned with respect to each other so as to collectively achieve a desired hull trim change, including listing control and planing control of the power boat. The rudder blades can be positioned with respect to each other to collectively achieve a hull trim change while maintaining the rudder blades substantially aligned with the water flow direction past the rudder blades so as to achieve the hull trim change substantially without increased hydrodynamic appendage drag beyond levels provided by rudder based steering systems. This may allow for a low-drag, highly efficient, trimming system for a planing power boat.

In accordance with a first aspect of the invention, the trimmable rudder system may provide combined steering and trimming capabilities for a power boat. A steering system of the power boat controls direction of travel of the power boat and includes a steering actuator and a rudder assembly that includes a rudder blade that extends generally vertically into the water. A rudder shaft of the rudder assembly is connected to the steering actuator and has a longitudinal axis. The rudder shaft can rotate about the longitudinal axis to rotate the rudder blade for steering the power boat. A joint is arranged between a hull of the power boat and the rudder assembly so that the rudder shaft can pivot about an axis that extends in a transverse direction through the joint that is generally perpendicular to the longitudinal axis of the rudder shaft. This may allow for controlling a rudder assembly to allow compound movements of a rudder blade for providing positive or negative lift forces to the power boat to induce trimming and/or other hull orientation effects.

In accordance with another aspect of the invention, the joint may be a ball-and-socket joint. The rudder shaft and the rudder blade may extend from opposing sides of the ball-and-socket joint. The ball-and-socket joint may include a ball that has a ball passage extending therethrough and the rudder shaft may extend through and rotate inside of the ball passage. A collar may be connected to and extend from the ball so that the collar and ball move in unison with each other. The collar may have a collar passage that is aligned with the ball passage so that the rudder shaft extends through and can rotate inside of both of the ball and collar passages. This may allow for a compact configuration that can be housed substantially entirely inside of a hull while allowing for compound, multi-axis, positional control of a rudder blade.

In accordance with another aspect of the invention, the power boat has a hull that is configured to allow the power boat to travel through water at a planing speed, and the power boat includes a pair of rudder assemblies extending from the hull and connected to the steering system. Each of the rudder assemblies may include a rudder blade that extends generally vertically into the water and a rudder shaft that is connected to the steering system and has a longitudinal axis about which the rudder shaft can rotate to correspondingly rotate the rudder blade for steering the power boat. A joint, which may be a ball-and-socket joint, is arranged between a hull of the power boat and the rudder so that each respective rudder shaft and rudder blade can pivot toward and away from each of the bow, the stern, the port side, and the starboard side, of the hull. This allows for coordinated movements of the rudder blades to provide substantial amounts of control of hull trim changes while minimizing appendage drag.

In accordance with another aspect of the invention, a drive having at least one propeller is aligned with a centerline of the hull and the pair of rudder assemblies is arranged on opposing sides of the centerline of the hull. This may be a single engine implementation of, the power boat. In a two-engine implementation of the power boat, a pair of drives, each of which includes at least one propeller, is arranged on opposing sides of a centerline of the hull. The pair of rudder assemblies may be aligned with the pair of drives so that each rudder assembly is positioned within a jet-stream of the respective drive.

In accordance with another aspect of the invention, each of the rudder assemblies includes a trim actuator that can pivot the respective rudder blade in a longitudinal direction with respect to the hull and a camber actuator that can pivot the respective rudder blade in a transverse direction with respect to the hull. The steering system can operate the trim and camber actuators of the rudder assemblies independent of each other. Movement of the trim and camber actuators can be coordinated to provide an infinitely variable adjustment of position of each of the rudder blades. The trim, camber, and steering actuators can include hydraulic rams, other linear actuators such as electric motor driven ball and screw actuators or, optionally, non-linear actuators. This may provide a system for both steering and trim control that requires relatively few components.

In accordance with another aspect of the invention, a steering arm that is moved by the steering actuator is connected to and rotates in unison with the rudder shaft. A plate that supports the steering arm and the steering actuator may be arranged toward an upper end of each of the rudder assemblies. The plate may be spaced from the hull and move in unison with upper end of the rudder assembly. This may allow the steering actuator to maintain an alignment with the rudder shaft even while the rudder shaft and rudder blades move in trim and camber directions which allows the steering actuator to be able to rotate the rudder shaft regardless of the position of the rudder shaft and rudder blade with respect to the bow, the stern, the port side, and the starboard side, of the hull.

In accordance with another aspect of the invention, a pair of steering actuators may be supported on the plate and engages opposing ends of the steering arm. The steering actuators may be arranged on opposing sides of the rudder shaft which allows the steering actuators to advance or regress in opposite directions to rotate the rudder shaft, which may allow for relatively small actuators to be implemented for rotating the rudder shaft and thus a relatively compact unit for tiller-type steering function at each of the rudder assemblies.

According to another aspect of the preferred embodiments, methods of steering and trimming a planing vessel via the claimed apparatus are, also provided.

Various other features, embodiments, and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

Figure 1:
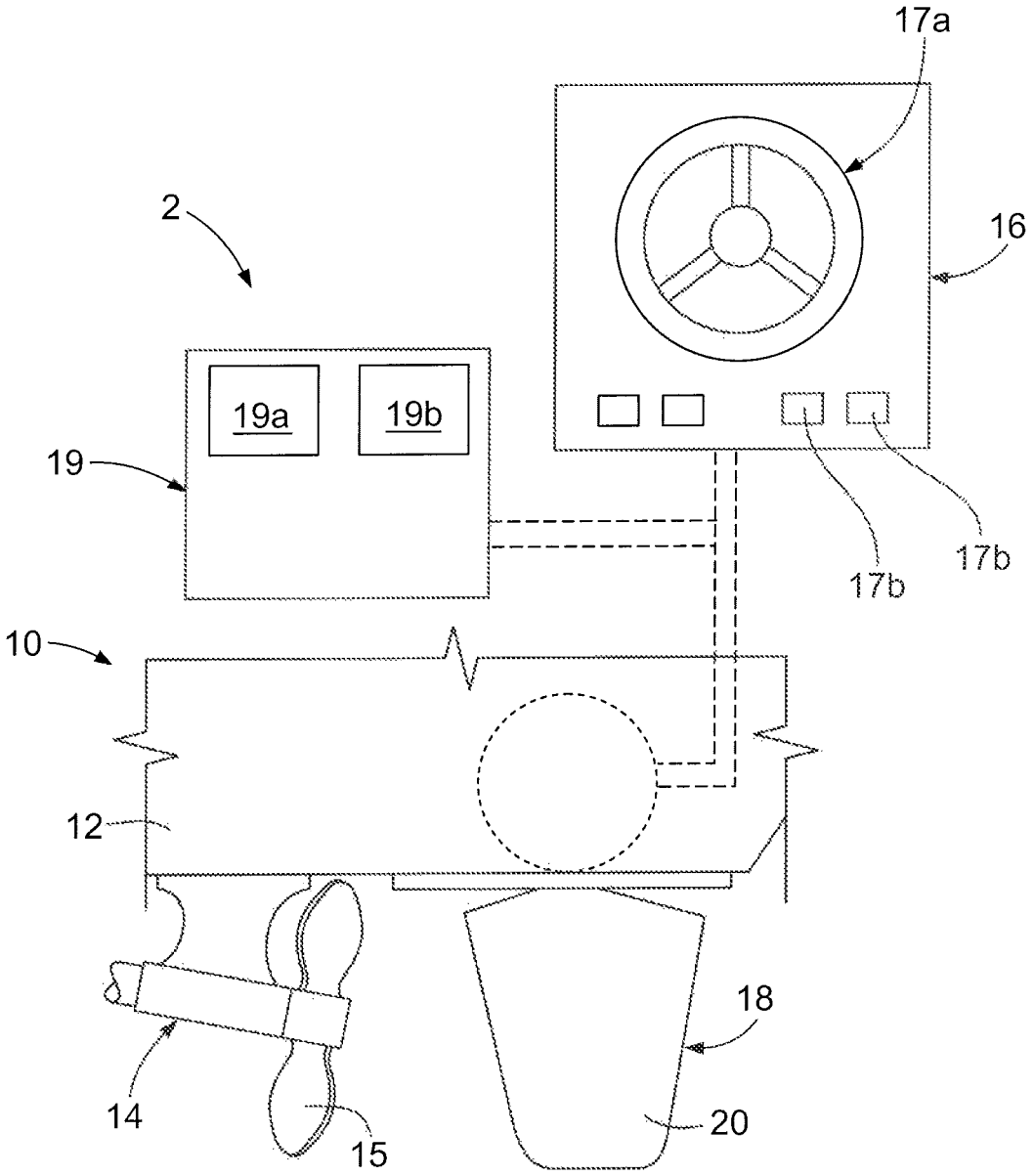
FIG. 1 is a simplified schematic representation of a trimmable rudder system according to the invention.

Referring to FIG. 1, a trimmable rudder system 2 is shown as provided in a marine vessel, e.g., a power boat 10 that includes a hull 12 which defines a bow at the front of the hull 12, a stern at the back of the hull 12, and port and starboard sides at the left and right sides of the hull 12. Hull 12 and thus power boat 12 are configured for traveling through water at a planing speed. The power boat 10 includes at least one drive 14 that receives power from an, engine (not shown) and that includes at least one propeller 15, as is generally understood. A steering system 16 is provided for controlling the direction of travel as well as trimming of the vessel, as will be discussed. The steering system 16 includes a steering wheel 17A, a trim control button(s) 17B, or other user control interface that is operably connected to at least one rudder assembly 18, preferably a pair of rudder assemblies 18, for controlling the rudder assembly or assemblies 18. A control system 19 may be operably connected to the steering system 16 and each of the rudder assemblies 18. The control system 19 may include a controller 19A and power supply 19B, as is known, for controlling various components of the rudder assemblies 18, explained in greater detail elsewhere herein, and based on user inputs from the steering system 16. The controller 19A can include an industrial computer or, e.g., a programmable logic controller (PLC), along with corresponding software and suitable memory for storing such software and hardware including interconnecting conductors for power and signal transmission for controlling electronic or electro-mechanical components of the rudder assemblies 18 and can also include valve assemblies for controlling hydraulic components of the rudder assemblies 18.

Figure 2:
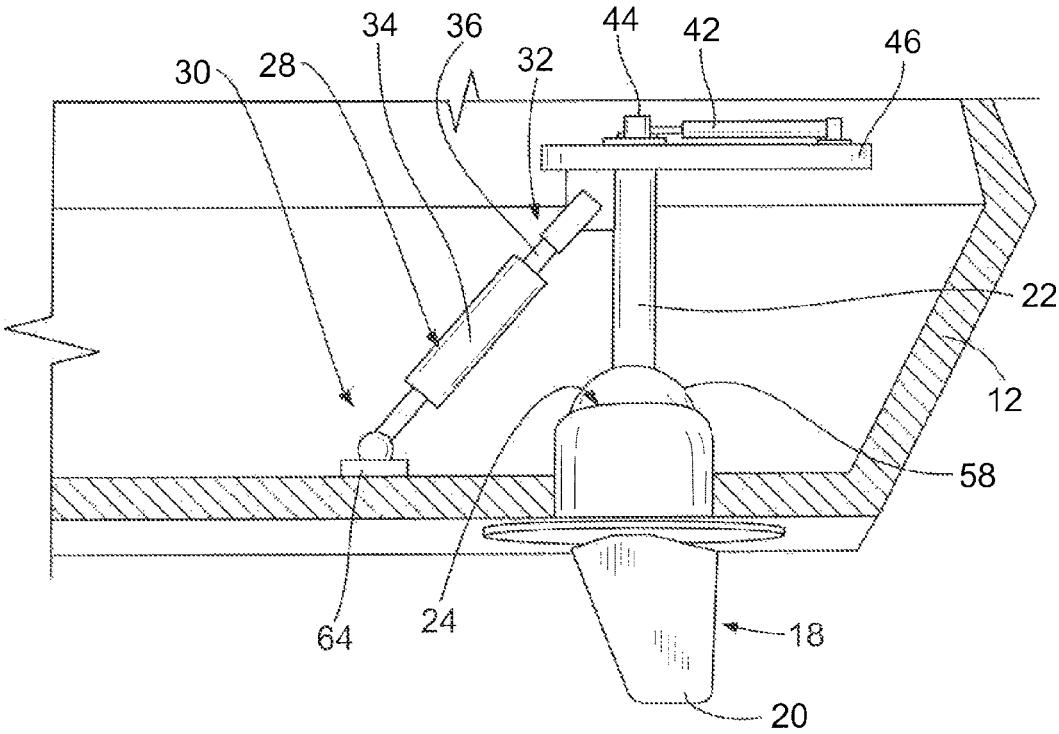
FIG. 2 is a partial cross-sectional view of the marine vessel illustrating a trimmable rudder assembly of FIG. 1.
Figure 3:
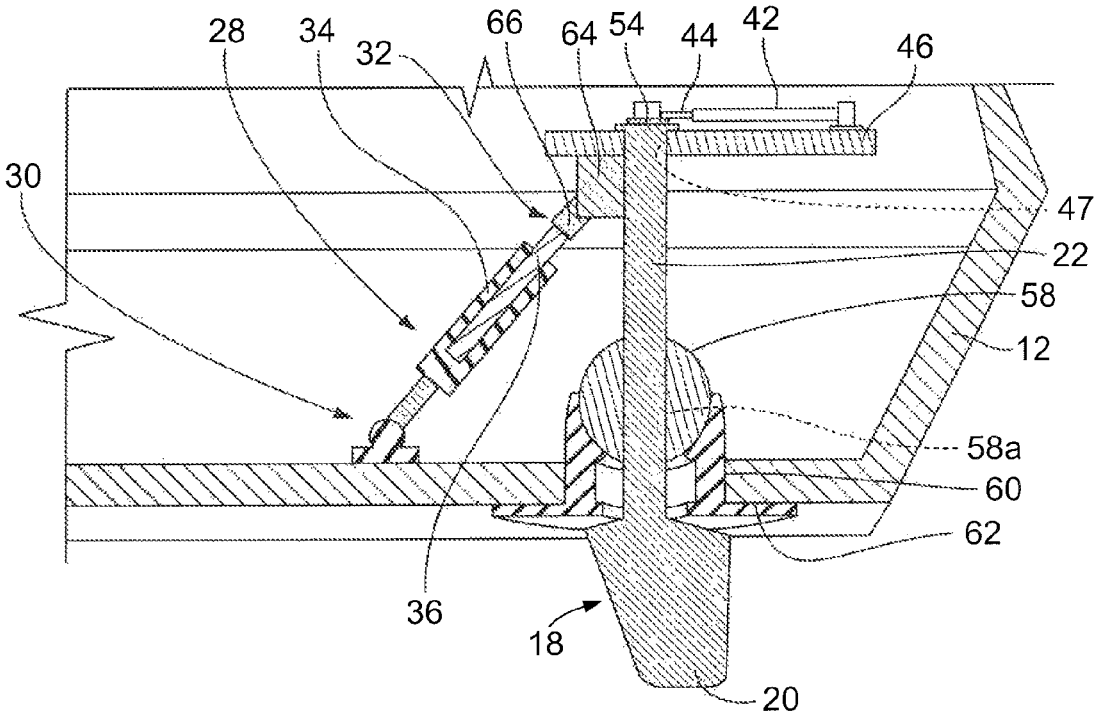
FIG. 3 is a cross-sectional view of the trimmable rudder assembly as shown in FIG. 2.

Referring now to FIGS. 2 and 3, each rudder assembly 18 may be housed within an engine room or otherwise below a deck of the power boat 10, with the rudder blade 20 extending below a bottom wall of the hull 12 into the water. Each rudder assembly 18 includes a rudder blade 20 that is connected to a rudder shaft 22 defining a longitudinal axis about which the rudder blade 20 and shaft 22 may be rotated as controlled by the steering system 16 for steering the power boat 10. The rudder shaft 22 is coupled to a joint that is shown as a ball-and-socket joint 24 that is disposed between the rudder blade 20 and the steering system 16. The ball-and-socket joint 24 allows movement of the rudder blade 20 in a number of additional planes and about multiple axes to provide compound, multi-axis, positional control of each rudder blade 22, in addition to the rotation about the longitudinal axis of the rudder shaft 22 for steering. Coordinating the movements of the rudder blades 20 by way of the steering and control systems 16, 19 allows the trimmable rudder system 2 (FIG. 1) to achieve desired hull trim changes, including listing control and planing control of the power boat 10.

Figure 4:
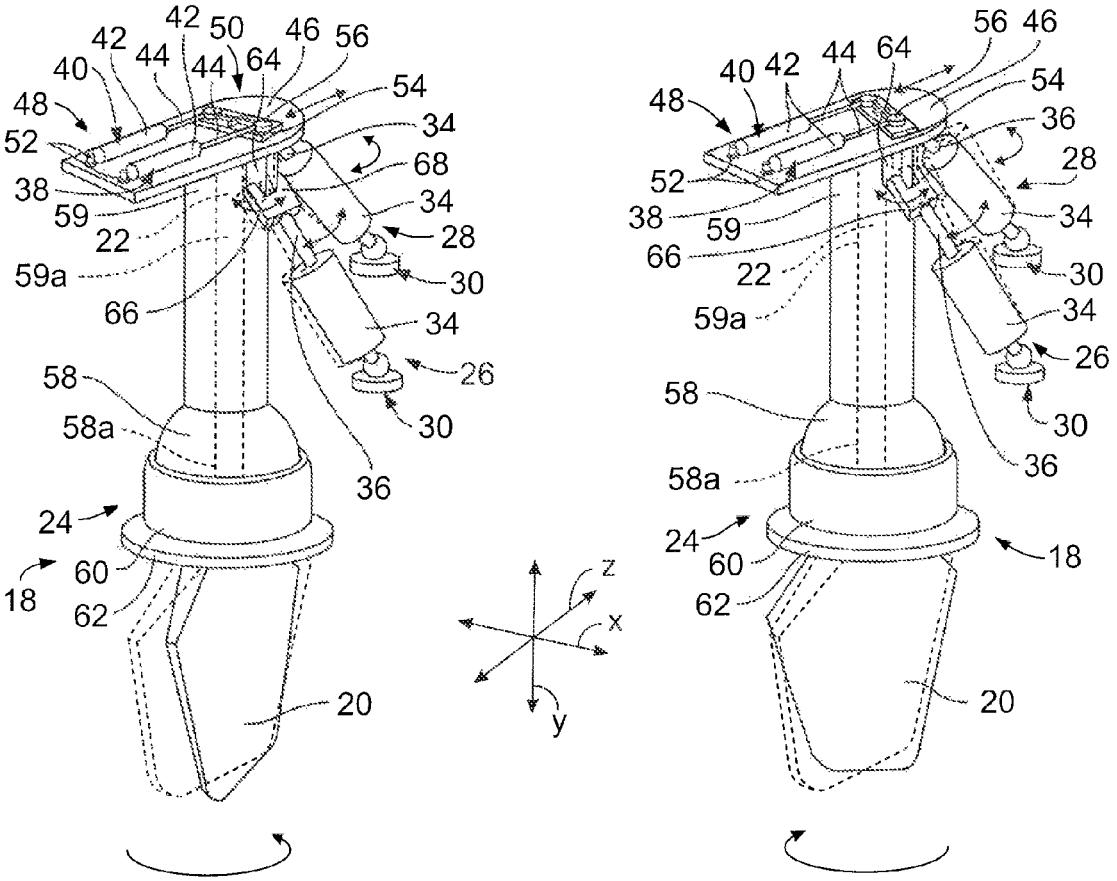
FIG. 4 is an isometric view of a variant of the trimmable rudder assembly of FIG. 2 showing movement of a rudder thereof in phantom.
Figure 5:
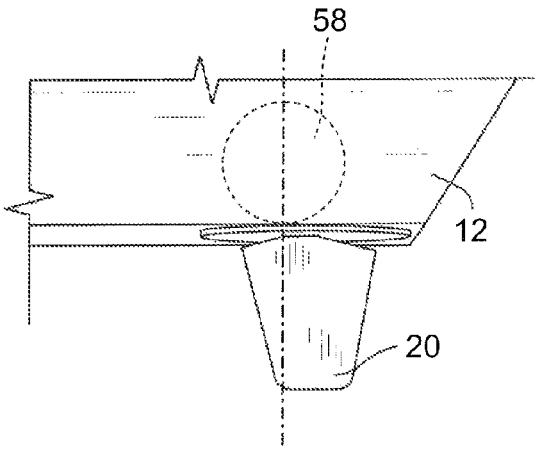
FIG. 5 is a side elevation view of the trimmable rudder assembly of FIG. 1 showing the rudder in a neutral position.

Referring now to FIG. 4, at each rudder assembly 18, the steering system 16 (FIG. 1) is operably coupled to a pair of actuators, shown as camber actuator 26 and trim actuator 28 that connect to an upper end of rudder assembly to control trim and camber movements, respectively, of the rudder blade 22. Camber and trim actuators 26, 28 are shown as hydraulic ram-style linear actuators, although it is understood that other linear actuators such as pneumatic rams, hydraulic-pneumatic rams, and electric motor driven ball and screw actuators, optionally non-linear actuators, may be used. The camber actuator 26 and the trim actuator 28 are similarly constructed such that reference to one is equally applicable to the other. The camber and trim actuators 26 and 28 have a first end 30 coupled to the hull 12 of the power boat 10 and a second end 32 opposite the first end 30 and coupled to the rudder assembly 18. The camber and trim actuators 26 and 28 each has a cylinder 34 that securely receives a movable rod 36, which may include a piston coupled to an end thereof. The rod 36 is movable relative to the cylinder 34 upon introduction of a fluid such as a liquid-like oil. In particular, the camber and trim actuators 26 and 28 are operably coupled to a hydraulic fluid source that is operably controlled by way of the steering system 16 of the power boat 10 as is known in the art.

Still referring to FIG. 4, the trimmable rudder system 2 (FIG. 1) further includes at least one steering actuator, shown as a pair of steering actuators 38 and 40, operably coupled to the rudder blade 20 for rotation about a vertical axis thereof. Like the camber and trim actuators 26 and 28, the steering actuators 38 and 40 are linear actuators that include a cylinder 42 and which include a rod 44, respectively, movable with respect thereto. The rods 44 may each include a piston at ends thereof as is generally understood in the art. The cylinders 42 may be in communication with a fluid source in the same manner as the camber and trim actuators 26 and 28 as may be generally understood. The actuators 38 and 40 may be supported on a plate 46 or similar structure and include first and second ends 48 and 50 opposite one another and coupled to opposite ends of the plate 46. In particular, the first end 48 is coupled to the plate 46 at a post 52 that is rigidly connected to the plate 46. At the opposite end, the second end 50 of the actuators 38 and 40 are coupled to a movable steering arm 54 that is coupled to the shaft 22 and configured to transmit rotation thereto, as will be described. The rods 44 are movably coupled to corresponding pins 56 coupled to the steering arm 54. The actuators 38 and 40 are configured to operate in opposition to one another and are in fluidic communication with a fluid source such as oil, water, or the like. In this manner, to extend the rod 44 of one of the actuators 38 and 40, the corresponding cylinder 42 is filled with fluid so that the rod 44 moves relative thereto. The movement of the rod 44 urges the steering arm to rotate about a vertical axis to thereby rotate the shaft 22, as will be described further herein.

Referring again to FIGS. 2 and 3, the plate 46 of the rudder assembly 18 is spaced from the hull 12 and moves in unison with an upper end of the rudder assembly 18 while supporting the steering actuators 38, 40. This maintains the steering actuators 38, 40 in a position with respect to the steering arm 54 and rudder shaft 22 so that the steering actuators 38, 40 can always push or pull the steering arm 54 and turn the rudder shaft 22, regardless of the position of the rudder shaft 22 with respect to the hull 12. Plate 46 is oriented orthogonally to the rudder shaft 22 and configured to accommodate rotation of the shaft 22 about its vertical axis by way of the steering arm 54 for rotating the rudder blade 20, the shaft 22 extends through a hole 47 (FIG. 3) in the plate 46 and is coupled for rotation in unison with the steeling aim 54. The shall 22 extends downwardly from the plate 46 and through the ball-and-socket joint 24, which correspondingly includes a ball 58. A hole, aperture, or other such passage, shown as ball passage 58A (FIG. 3), extends through the ball 58.

Referring again to FIG. 4, the ball-and-socket joint 24 differs from that shown in FIGS. 2 and 3 in that the ball-and-socket joint 24 of FIG. 4 includes a collar 59 that extends upwardly from the ball 58 concentrically around the rudder shaft 22. A collar passage 59A extends longitudinally through the collar 59 and aligns with the ball passage 58A. In this way, the rudder shaft 22 extends through both the ball and collar passages 58A, 59A.

Still referring to FIG. 4, the ball 58 is received in a socket 60. The socket 60 holds the ball 58 in a manner that allows the ball 58 to freely rotate in the socket 60, as will be discussed in additional detail herein. The socket 60 may include a recess or similar spherical void toward an upper end of the socket 60 for receiving the ball 58 while permitting rotating articulation of the ball 58. At a lower end of the socket 60, a hole, aperture, or passage is provided through which the shaft 22 may extend beneath the hull 12 of the power boat 10 and direct movement of the rudder blade 20, which is affixed to a distal end of the shaft 22. The socket 60 may include a generally flat bottom flange 62 which is coupled to and sealed against an underside of the hull 12 of the power boat 10.

Still referring to FIG. 4, the rudder assembly 18 is shown in further detail and its operation will now be further explained. As previously described, the camber and trim actuators 26 and 28 and 38 and 40 are operably coupled to a fluid source as is generally understood. Understandably, alternative actuator assemblies are within the scope of the present invention and may be utilized in driving movement of the rudder assembly 18.

The camber actuator 26, as previously discussed, is coupled at it second end to the rudder assembly 18. More particularly, the camber actuator 26 is coupled to a mounting block 64 disposed beneath the plate 46 and coupled to the shaft 22 in a manner so as to generate camber to the rudder blade 20 as will be explained. The second end of the camber actuator 26 includes a pin 66 that is coupled to the mounting block 64 and which is movable to drive movement of the rudder assembly 18. The pin 66 connects to a yoke 68 to couple the mounting block 64 and the camber actuator 26 to each other. Thus, as desired, the operator of the power boat 10 may adjust the camber angle of the rudder blade 20, and thus the transverse angle of the rudder blade 20 with respect to the hull 12, by applying the appropriate actuation through the camber actuator 26 as controlled by inputting a command through the steering system 16, for example, by manipulating the trim control button(s) 17B. In this manner, the rod 36 may be moved relative to the cylinder 34 to apply a force to the rudder assembly 18 via the shaft 22 (FIGS. 2 and 3) and/or collar 59 (FIG. 4) to thereby adjust the camber of the rudder blade 20. In particular, to adjust the camber of the rudder blade 20 toward the port side of the vessel, the rod 36 may be retracted into the cylinder 34 such that the upper end of the rudder assembly 18 is pulled toward the starboard side of the power boat 10 while the bottom edge of the rudder blade 20 tilts toward the port side. To adjust the camber of the rudder blade 20 toward the starboard side, the rod 36 is extended from the cylinder 34 in an inverse manner as may be appreciated.

In a similar manner, the trim actuator 28 may be directed to adjust the trim angle of the rudder blade 20. The rudder blade 20 may be pivoted toward the bow of the power boat 10 by extending the rod 36 from the cylinder 34 and may be pivoted toward the stern of the power boat 10 by retracting the rod 36 into the cylinder 34. In this manner, the camber actuator 26 and trim actuator 28 may simultaneously direct movement of the rudder blade 20 to provide compound movements that adjust both camber and trim angles of the rudder blade 20. To control rotation of the rudder blade 20 about its vertical axis or the shaft 22, the operator of the power boat 10 may turn the steering wheel 17A to actuate the opposing actuators 38 and 40. In particular, to rotate the rudder blade 20 in a first, clockwise direction when viewed from below, the rod 44 of the actuator 40 is moved rearwardly while the rod 44 of the actuator 38 is moved forwardly. The movement of the rods 44 in this manner rotates the steering arm 54 about a vertical axis. The steering arm 54 is coupled to the rudder shaft 22 and thereby rotates the rudder blade 20 in unison with the steering arm 54. This is shown in FIG. 4 at the rudder assembly 18 on the left-hand side in which the rudder blade 20 moves from its position shown in phantom outline to its position in solid outline. To rotate the rudder blade 20 in the second, counter-clockwise direction when viewed from below, the rods 44 of the actuators 38 and 40 are moved rearwardly and forwardly, respectively. In this manner, the movement of the actuators 38 and 40 is applied to the steering arm 54 to which the shaft 22 is coupled, which transmits to rotation of the rudder blade 20. This is shown in FIG. 4 at the rudder assembly 18 on the right-hand side in which the rudder blade 20 moves from its position shown in phantom outline to its position in solid outline.

Figure 6:
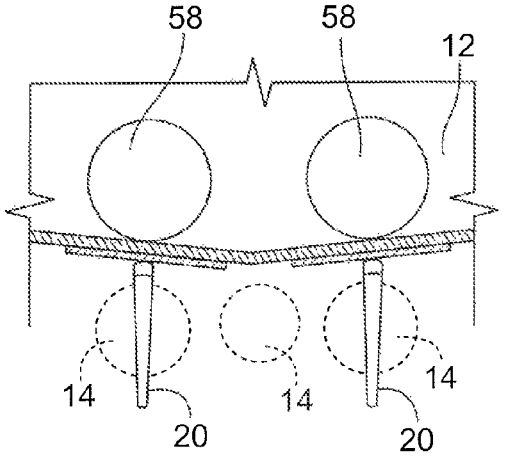
FIG. 6 is a rear elevation of a simplified schematic representation of a pair of trimmable rudder assemblies according to another embodiment of the invention showing a control unit in a neutral position.

With additional reference now to FIGS. 5-10, preferably the trimmable rudder system 2 includes a pair of rudder assemblies 18. Referring to FIG. 6, the drive 14 in the middle shows a position of a dive 14 for a single drive and single engine application. In such a single drive application, the rudder assemblies 18 are arranged transversely outward of the drive 14. The two drives 14 at the outside of FIG. 6 show a position of a pair of drives 14 for a two drive, which may be a two engine, application. In such two drive applications, the rudder assemblies 18 are aligned with and aft of the drives 14. This arranges the rudder assemblies 18 within jet-streams of propellers of the drives 14.

As can be seen in FIGS. 5-10, the rudder blades 20 may be adjusted to carry out a number of positional changes and coordinated movements simultaneously to provide steering and/or non-steering hull movements, including desired hull trim changes for listing control and planing control of the power boat 10. With momentary reference to FIG. 5, one of the rudder blades 20 of the present embodiment is shown in a generally neutral position. Understandably, the other of the rudder blades 20 is not visible so it is likewise positioned in the neutral position as shown. Now with reference to FIG. 6, the rudder blades 20 are shown in a camber neutral position in keeping with the present invention.

Figure 7:
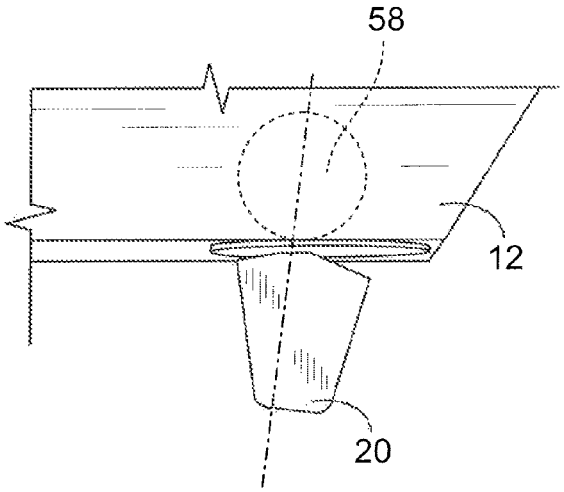
FIG. 7 is a side elevation view of the trimmable rudder assemblies of FIG. 6 showing the rudder blade(s) in a forward-rake position.

With reference now to FIG. 7, one of the rudder blades 20 is shown in a forward-rake position in which a bottom edge of the rudder blade 20 is tilted forward relative to the neutral position. In this manner, a negative lift may be applied to the bow of the hull 12 so as to urge the bow downward. Now referring to FIG. 8, the rudder blades 20 are shown in a camber-out configuration in which both of the rudder blades 20 are angled outwardly relative to their neutral positions. Shown in phantom outline in FIG. 8, leading edges of the rudder blades 20 can be angled toward each other to provide a toe-in configuration. With the rudder blades 20 positioned in a camber-out and toe-in arrangement, positive lift can be achieved to urge the bow of the hull 12 upward.

Figure 8:
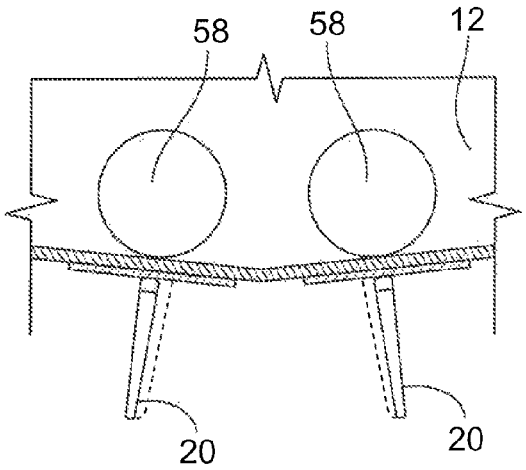
FIG. 8 is a rear elevation of, the trimmable rudder assemblies of FIG. 6 showing the rudder blades in a camber-out position.
Figure 9:
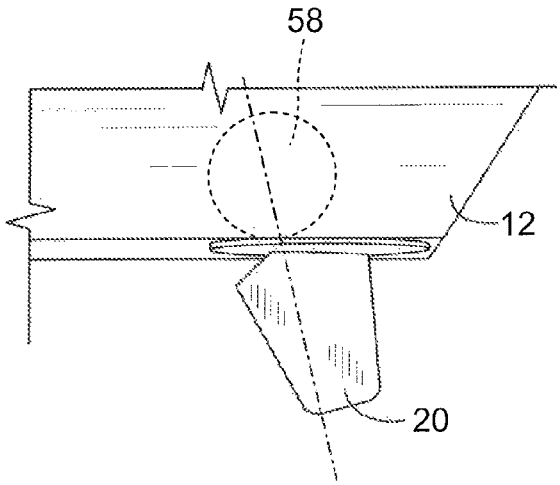
FIG. 9 is a side elevation view of the trimmable rudder assembly of FIG. 6 showing the rudder blade(s) in a rear-rake position.
Figure 10:
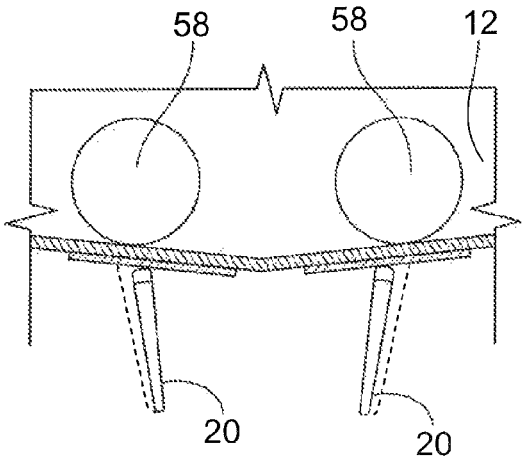
FIG. 10 is a rear elevation view of the trimmable rudder assembly of FIG. 6 showing the rudder blades in a camber-in position.

Referring now to FIGS. 9 and 10, the rudder blades 20 are shown in generally opposite positions as those shown in FIGS. 7 and 8, respectively. As shown in FIG. 9, the rudder blades 20 are in a rear-rake position in which the bottom edge of the rudder blade 20 is tilted rearward relative to the neutral position. In this manner, a positive lift may be applied to bow of the hull 12 so as to urge the bow upward. Now referring to FIG. 10, the rudder blades 20 are shown in a camber-in configuration in which both of the rudder blades 20 are angled inward relative to their neutral positions. Shown in phantom outline in FIG. 10, leading edges of the rudder blades 20 can be angled away from each other to provide a toe-out configuration. With the rudder blades 20 positioned in a camber-in and toe-out arrangement, negative lift can be achieved to urge the bow of the hull 12 downward.

Although the best mode contemplated by the inventors of carrying out the present invention is disclosed above, practice of the present invention is not limited thereto. It will be manifest that various additions, modifications, and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

I claim:

1. A trimmable rudder system for a power boat comprising:

a steering system for controlling direction of travel of the power boat and that includes a steering actuator;

a rudder assembly that is connected to the steering system and includes a rudder blade that extends generally vertically into the water and a rudder shaft that is connected to the steering actuator and has a longitudinal axis and that can rotate about the longitudinal axis to rotate the rudder blade for steering the power boat;

a hull defining a bow and a stern; and a joint that is arranged between the hull of the power boat and the rudder assembly so that the rudder shaft can pivot about an axis that extends in a transverse direction through the joint that is generally perpendicular to the longitudinal axis of the rudder shaft, and at least one actuator configured to selectively and controllably pivot the rudder shaft toward and away from each of the bow and the stern.

2. The trimmable rudder system of claim 1, wherein the joint is a ball-and-socket joint.

3. The trimmable rudder system of claim 2, wherein the rudder shaft and the rudder blade extend from opposing sides of the ball-and-socket joint.

4. The trimmable rudder system of claim 2, wherein the ball-and-socket joint comprises a ball that includes a ball passage that extends through the ball and wherein the rudder shaft extends through and can rotate with respect to the ball inside of the ball passage.

5. The trimmable rudder system of claim 4, wherein a collar is connected to and extends from the ball so that the collar and ball move in unison with each other, the collar including a collar passage that is aligned with the ball passage, and wherein the rudder shaft extends through and can rotate inside of both of the ball and collar passages.

6. A power boat comprising:

a hull defining a bow, a stern, a port side, and a starboard side, and configured for traveling through water at a planing speed;

a steering system for controlling direction of travel of the hull through the water; and a pair of rudder assemblies that extend from the hull and are spaced from each other and are operably connected to the steering system, each of the rudder assemblies including:

a rudder blade that extends generally vertically into the water and a rudder shaft that is connected to the steering system and has a longitudinal axis, wherein the rudder shaft can rotate about the longitudinal axis to rotate the rudder blade for steering the power boat;

a joint that is arranged between the hull of the power boat and each of the rudder assemblies, and actuators configured to selectively and controllably pivot each respective rudder shaft and rudder blade toward and away from each of the bow, the stern, the port side, and the starboard side of the hull.

7. The power boat of claim 6, wherein the joint is a ball-and-socket joint.

8. The power boat of claim 7, further comprising a drive having at least one propeller that is aligned with a centerline of the hull and wherein the pair of rudder assemblies is arranged on opposing sides of the centerline of the hull.

9. The power boat of claim 7, further comprising a pair of drives each of which includes at least one propeller, the pair of drives arranged on opposing sides of a centerline of the hull, and wherein the pair of rudder assemblies is aligned with the pair of drives.

10. The power boat of claim 6, wherein the steering system includes a steering actuator that is movable for rotating the rudder shaft.

11. The power boat of claim 10, further comprising a steering arm connected to and rotating in unison with the rudder shaft and wherein the steering actuator engages the steering arm for rotating the steering arm relative to the longitudinal axis of the rudder shaft.

12. The power boat of claim 11, further comprising a plate that supports the steering actuator at an upper end of the respective rudder assembly, wherein the plate is spaced from the hull and moves in unison with the upper end of the rudder assembly so that the steering actuator can rotate the rudder shaft when the rudder shaft and the rudder blade are pivoted toward and away from each of the bow, the stern, the port side, and the starboard side of the hull.

13. The power boat of claim 12, wherein the steering actuator comprises a pair of steering actuators supported on the plate and engaging opposing ends of the steering arm.

14. The power boat of claim 13, wherein the pair steering actuators is arranged on opposing sides of the rudder shaft.

15. A power boat comprising:

a hull defining a bow, a stern, a port side, and a starboard side, and configured for traveling through water at a planing speed;

a steering system for controlling direction of travel of the hull through the water; and a pair of rudder assemblies that extend from the hull and are spaced from each other and are operably connected to the steering system, each of the rudder assemblies including:

a rudder blade that extends generally vertically into the water and a rudder shaft that is connected to the steering system and has a longitudinal axis, wherein the rudder shaft can rotate about the longitudinal axis to rotate the rudder blade for steering the power boat;

a joint that is arranged between the hull of the power boat and each of the rudder assemblies so that each respective rudder shaft and rudder blade can pivot toward and away from each of the bow, the stern, the port side, and the starboard side of the hull;

wherein the joint is a ball-and-socket joint; and wherein each of the rudder assemblies includes a trim actuator that can pivot the respective rudder blade in a longitudinal direction with respect to the hull and a camber actuator that can pivot the respective rudder blade in a transverse direction with respect to the hull.

16. The power boat of claim 15, wherein the steering system can operate the trim and camber actuators of the rudder assemblies independent of each other.

17. The power boat of claim 15, wherein the trim and camber actuators include hydraulic rams.

18. The power boat of claim 15, wherein the steering system includes a steering actuator that is movable for rotating the rudder shaft; and a steering arm connected to and rotating in unison with the rudder shaft and wherein the steering actuator engages the steering arm for rotating the steering arm relative to the longitudinal axis of the rudder shaft.

19. The power boat of claim 18, further comprising:

a plate that supports the steering actuator at an upper end of the respective rudder assembly, wherein the plate is spaced from the hull and moves in unison with the upper end of the rudder assembly so that the steering actuator can rotate the rudder shaft when the rudder shaft and the rudder blade are pivoted toward and away from each of the bow, the stern, the port side, and the starboard side of the hull.

20. The power boat of claim 19, wherein a pair of steering actuators is supported on the plate and engages opposing ends of the steering arm.

21. The power boat of claim 20, wherein a pair of steering actuators is arranged on opposing sides of the rudder shaft.

* * * * *